US009307802B2

(12) United States Patent
Hall

(10) Patent No.: US 9,307,802 B2
(45) Date of Patent: Apr. 12, 2016

(54) HELMET SUSPENSION SYSTEM

(71) Applicant: Revision Military S.a.r.L., Luxembourg (LU)

(72) Inventor: Edward R. Hall, Montreal (CA)

(73) Assignee: Revision Military S.a.r.L., Luxembourg (LU)

( * ) Notice: Subject to any disclaimer, the term of this patent is extended or adjusted under 35 U.S.C. 154(b) by 454 days.

(21) Appl. No.: 13/657,828

(22) Filed: Oct. 22, 2012

(65) Prior Publication Data

US 2014/0109301 A1 Apr. 24, 2014

(51) Int. Cl.
*A42B 3/00* (2006.01)
*A42B 3/06* (2006.01)
*A42B 3/14* (2006.01)

(52) U.S. Cl.
CPC ... *A42B 3/06* (2013.01); *A42B 3/14* (2013.01); *A42B 3/142* (2013.01)

(58) Field of Classification Search
CPC . A42B 3/08–3/085; A42B 3/14; A42B 3/142; A42B 3/145; A42B 3/147
See application file for complete search history.

(56) References Cited

U.S. PATENT DOCUMENTS

| | | | | | |
|---|---|---|---|---|---|
| 2,814,043 | A | * | 11/1957 | Alesi | 2/421 |
| 3,154,788 | A | * | 11/1964 | Simpson | 2/418 |
| 3,383,705 | A | * | 5/1968 | Raschke | 2/416 |
| 3,758,889 | A | * | 9/1973 | Erb | 2/416 |
| 4,263,679 | A | * | 4/1981 | Erlendson | 2/421 |
| 4,888,831 | A | * | 12/1989 | Oleson | 2/420 |
| 4,942,628 | A | | 7/1990 | Freund | |
| 5,042,093 | A | * | 8/1991 | Legendre | 2/419 |
| 5,315,718 | A | * | 5/1994 | Barson et al. | 2/418 |
| 5,551,094 | A | | 9/1996 | Navone | |
| 5,572,749 | A | * | 11/1996 | Ogden | 2/421 |
| 5,581,819 | A | * | 12/1996 | Garneau | 2/421 |
| 5,794,272 | A | * | 8/1998 | Workman et al. | 2/421 |
| 5,898,949 | A | * | 5/1999 | Barthold et al. | 2/416 |
| 6,032,297 | A | * | 3/2000 | Barthold et al. | 2/416 |
| 6,081,931 | A | * | 7/2000 | Burns et al. | 2/411 |
| 6,292,952 | B1 | * | 9/2001 | Watters et al. | 2/411 |
| 6,968,575 | B2 | * | 11/2005 | Durocher | 2/425 |
| 7,124,449 | B2 | | 10/2006 | Sutter et al. | |
| 7,178,175 | B2 | | 2/2007 | Rogers et al. | |

(Continued)

FOREIGN PATENT DOCUMENTS

| | | |
|---|---|---|
| DE | 630 473 C | 5/1936 |
| DE | 81 38 228 U1 | 6/1983 |
| GB | 1 114 214 A | 5/1968 |

OTHER PUBLICATIONS

International Search Report and Written Opinion for PCT/IB2013/003041 mailed Feb. 9, 2015.

*Primary Examiner* — Khaled Annis
(74) *Attorney, Agent, or Firm* — Wolf, Greenfield & Sacks, P.C.

(57) ABSTRACT

Suspension systems for helmet assemblies provide enhanced stability and adjustability for installation in helmets across different platforms. A suspension system may include an upward stabilizing member extending from a support portion of the suspension system and a pivotally attached downward stabilizing member. The pivotal attachment between upward and downward stabilizing members allows the suspension to be appropriately incorporated into helmets that are subject to manufacturing and specification variability, while still providing flexibility for fit adjustments to the suspension system.

16 Claims, 12 Drawing Sheets

(56) References Cited

U.S. PATENT DOCUMENTS

| | | | | |
|---|---|---|---|---|
| 7,770,239 | B1 * | 8/2010 | Goldman et al. | 2/416 |
| 8,353,066 | B2 | 1/2013 | Rogers et al. | |
| 8,739,318 | B2 * | 6/2014 | Durocher | 2/417 |
| 2005/0217006 | A1 * | 10/2005 | Sutter et al. | 2/416 |
| 2006/0101560 | A1 * | 5/2006 | Ketterer et al. | 2/418 |
| 2009/0222978 | A1 * | 9/2009 | Fang | 2/421 |
| 2010/0229286 | A1 * | 9/2010 | Ahlgren et al. | 2/416 |
| 2011/0094018 | A1 * | 4/2011 | Rogers et al. | 2/421 |
| 2011/0277222 | A1 * | 11/2011 | Garneau et al. | 2/421 |
| 2012/0144565 | A1 * | 6/2012 | Huh | 2/421 |
| 2012/0144567 | A1 * | 6/2012 | Huh | 2/424 |
| 2012/0167281 | A1 | 7/2012 | Gennrich et al. | |
| 2013/0000016 | A1 * | 1/2013 | Hall et al. | 2/411 |
| 2013/0239303 | A1 * | 9/2013 | Cotterman et al. | 2/417 |

* cited by examiner

HELMET SUSPENSION SYSTEM

FIELD

Aspects of the present disclosure relate generally to suspension systems for helmet assemblies.

DISCUSSION OF RELATED ART

Helmets serve to protect the wearer against head injury when the wearer is at risk for impacts to the head. For instance, in modern combat, military helmets are used to withstand high-impact ballistics.

Helmets are often constructed to have an outer protective shell that is relatively rigid as compared with a softer and typically more flexible inner lining. Various types of helmets include a suspension system that enhances shock absorption characteristics of the helmet. In some cases, a suspension system is arranged to maintain the rigid protective shell at a safe distance from the head when the helmet is impacted, while permitting an acceptable degree of mechanical give. For example, suspension systems are often constructed to cradle the head by, at least in part, providing a pocket of cushioning or air between the head and the protective shell. Suspension systems are typically designed to be installed in a particular type of helmet manufactured according to set specifications.

SUMMARY

In an illustrative embodiment, a suspension system for a helmet assembly is provided. The suspension system includes a support portion to engage a wearer's head to help support the helmet assembly on the wearer's head. The suspension system also includes an upward stabilizing member extending from the support portion; and a downward stabilizing member pivotally attached to the upward stabilizing member and configured to be attached to an interior surface of a helmet.

In another illustrative embodiment, a suspension system for a helmet assembly is provided. The suspension system includes a fit-adjustment support portion having a first side and a second side. The suspension system also includes a first upward stabilizing member extending from the first side of the fit-adjustment support portion, and configured to be attached to an interior surface of a helmet; and a second upward stabilizing member extending from the second side of the fit-adjustment support portion and configured to be attached to an interior surface of the helmet.

According to another embodiment, a method of assembling a helmet assembly includes acts of providing a helmet, providing a suspension system including a support band, and attaching the suspension system to the helmet. The method also includes attaching a downward stabilizing member to the helmet, the downward stabilizing member being pivotally attached to an upward stabilizing member that is attached to the support band.

According to a further embodiment, a method of assembling a helmet assembly includes acts of providing a helmet and providing a suspension system including an adjustable band and a fit-adjustment support portion. The method further includes attaching the suspension system to the helmet, and attaching a first downward stabilizing member to the helmet, the first downward stabilizing member being attached to a first upward stabilizing member that is attached to the fit-adjustment support portion. Also included is an act of attaching a second downward stabilizing member to the helmet, the second downward stabilizing member being attached to a second upward stabilizing member that is attached to the fit-adjustment support portion.

Advantages, novel features, and objects of the invention will become apparent from the following detailed description of the invention when considered in conjunction with the accompanying drawings, which are schematic and which are not intended to be drawn to scale. For purposes of clarity, not every component is labeled in every figure, nor is every component of each embodiment of the invention shown where illustration is not necessary to allow those of ordinary skill in the art to understand the invention.

BRIEF DESCRIPTION OF THE DRAWINGS

The accompanying drawings are not intended to be drawn to scale. In the drawings, each identical or nearly identical component that is illustrated in various figures is represented by a like numeral. Various embodiments of the invention will now be described, by way of example, with reference to the accompanying drawings, in which.

DETAILED DESCRIPTION

Figure 1:
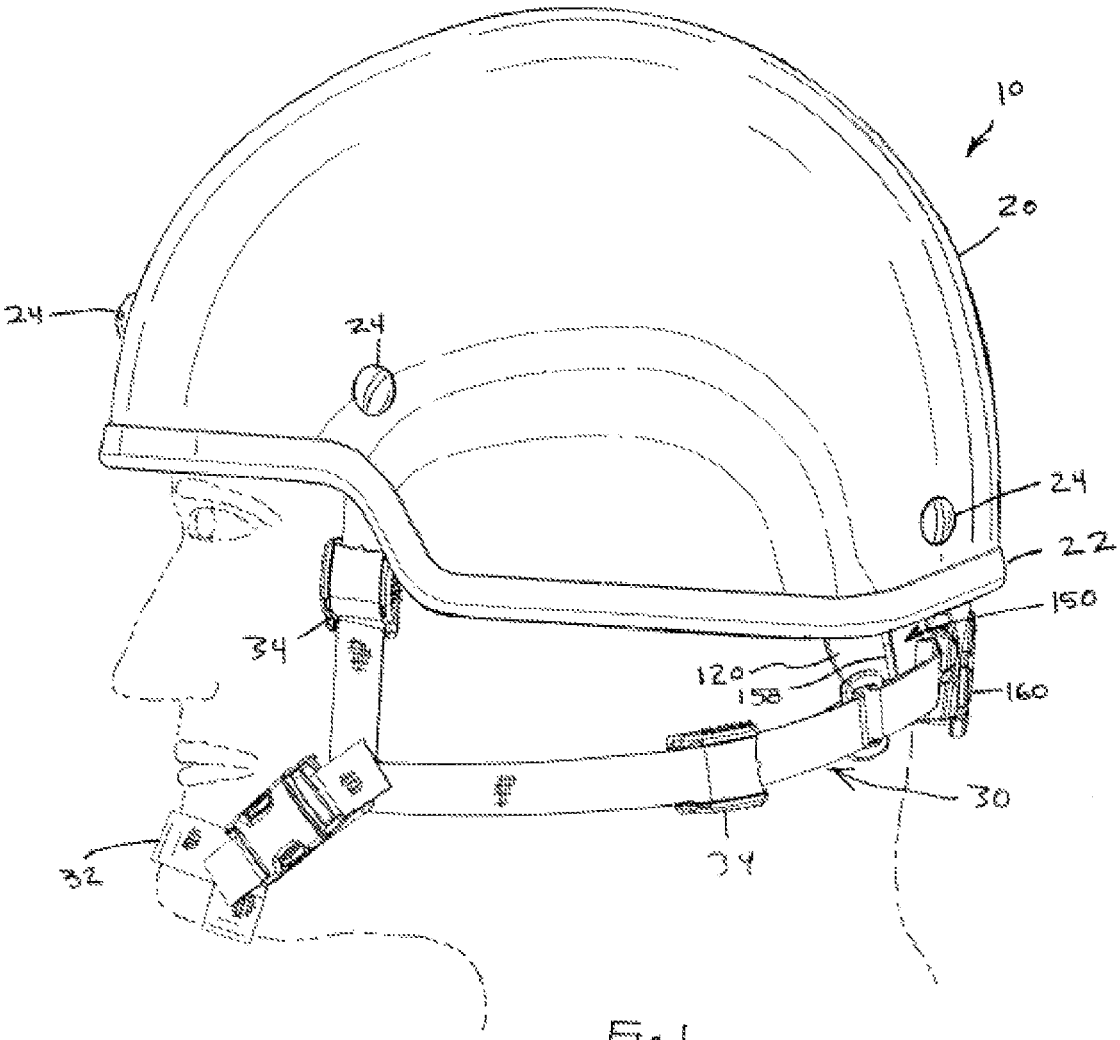
FIG. 1 depicts a side view of a helmet assembly placed on a head of a wearer in accordance with one embodiment.
Figure 2:
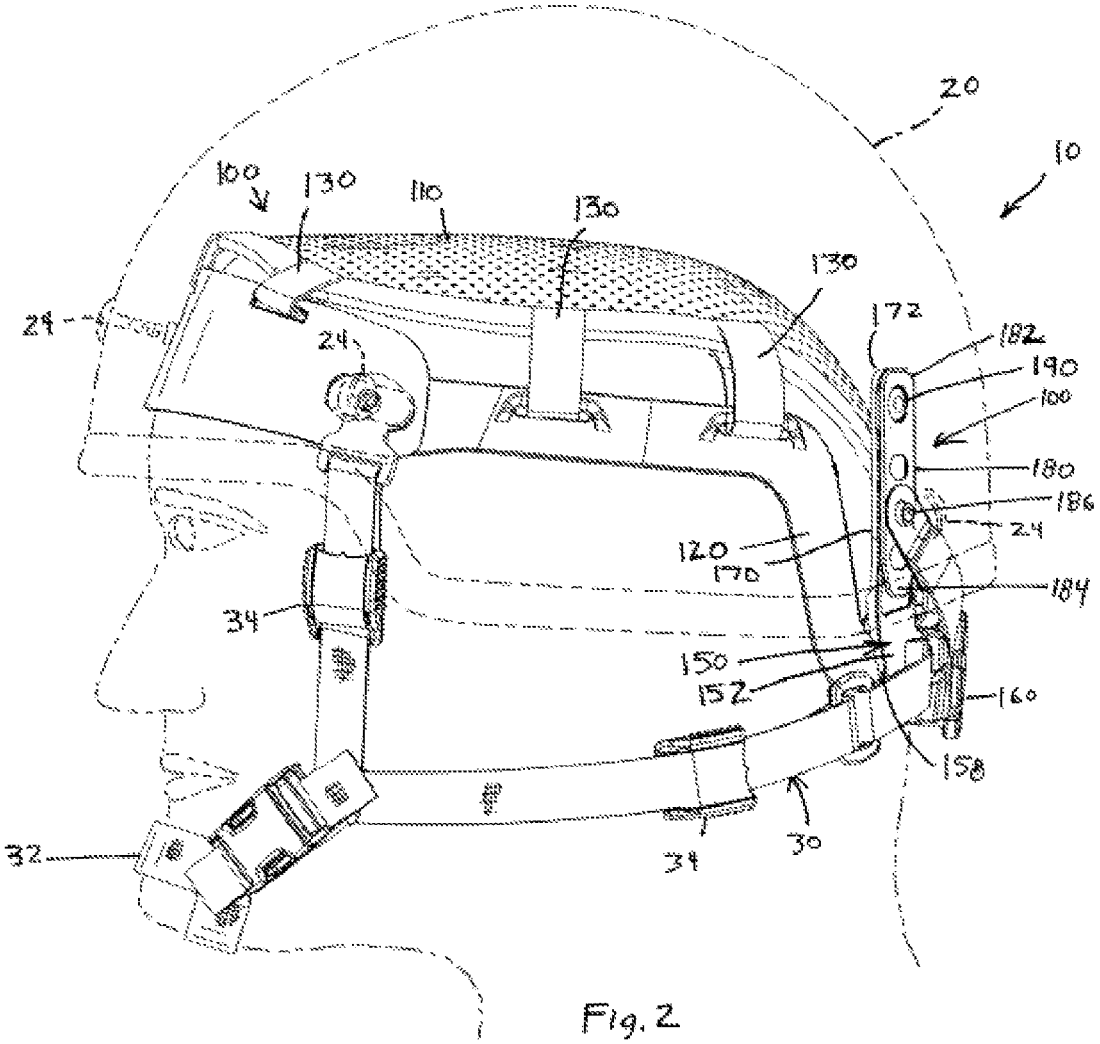
FIG. 2 illustrates another side view showing interior components of the helmet assembly of FIG. 1.

The present disclosure relates to helmet assembly suspension systems that provide enhanced stability to the helmet assembly relative to the head of the wearer. The present disclosure also relates to suspension systems having the ability to be incorporated into a number of different types of helmet assemblies, such as those that are produced according to differing standard/platform specifications and/or those that are subject to manufacturing variability. In some embodiments, the suspension assembly systems are particularly suited for use with military helmets or other helmets suited for high impact activities.

When helmet assemblies including suspension systems described herein are worn, the suspension systems may provide and maintain a separation between the head of the wearer and the rigid shell that forms a protective barrier around the head. The inventors have appreciated that, at times, when using a visual accessory such as night vision goggles or a helmet-mounted display, a wearer of certain helmet assemblies may experience motion sickness due to movements of the visual accessory. In particular, pitch and yaw rotations of the helmet on the head of a wearer may cause movements of the visual accessory relative to the wearer's eye(s). For instance, when a wearer of a helmet equipped with a night vision camera looks through the lens of the camera and engages in routine maneuvers, due to the weight of the helmet and/or equipment, there may be a tendency for the helmet to move or rotate in a manner that moves the visual equipment relative to the wearer's eye(s), leading to motion sickness and/or decreased effectiveness of the visual equipment.

Wearers of helmet assemblies equipped with suspension systems in accordance with the present disclosure may be less prone to suffer motion sickness or other types of discomfort during use due to improved stability. Improved stability in helmet suspension systems may be particularly beneficial in helmet assemblies that incorporate additional features (e.g., electronics, optics, eyewear, etc.) that add weight to the helmet or apply torque to the wearer. Without the stability provided by aspects of the present disclosure, during use, the helmet assembly may be subject to undesirable movement.

Helmet assemblies in accordance with aspects of the present disclosure may incorporate stabilizing features that beneficially provide a suitable degree of stability. In some embodiments, a suspension system includes one or more stabilizing members that extend from a support portion of the suspension system and attach to an interior of the helmet. The support portion engages with a wearer's head to help support the helmet assembly on the wearer's head. Such arrangements may result in an enhanced overall stability to the suspension system while not resulting in a detrimental sacrifice in flexibility, so that the helmet is able to fit comfortably on the head of a wearer.

While aspects of the present disclosure provide for improved stability for helmet assemblies incorporating suspension systems, the fit of such helmet assemblies to a wearer's head is not compromised. The adjustable features or other components of helmet assemblies described herein maintain an adequate amount of flexibility so as to be able to provide for a secure fit of the helmet to the wearer's head. In some embodiments, the suspension system includes an adjustable band that is positioned around the circumference of the head and is tightened so as to achieve a suitable fit. A fit-adjustment support portion from which stabilizing members extend may house a portion of the adjustable band. Accordingly, as the adjustable band is tightened, the stabilizing members may allow the adjustable band and/or the fit-adjustment support portion to move radially inwardly and outwardly, while still resisting various forces (e.g., tension, compression, torsion) and providing stability of the helmet on the wearer's head.

Suspension systems discussed herein may be suitable for use in helmets across different platforms, and/or have the ability to be incorporated into helmet assemblies that are subject to manufacturing variability. For example, the interior surface of the protective shell of one type of helmet (e.g., helmets manufactured in accordance with U.S. standards) may have attachment sites for a suspension system that are than the interior surface of the protective shell of another type of helmet (e.g., helmets manufactured in accordance with Canadian standards). As an example, the location of one or more holes bored into a protective shell where a suspension system may be attached may vary between different types of helmets. Differences in the location of a suspension system attachment to a helmet may vary from helmet-to-helmet even for helmets that are produced under the same specified standard/platform because of manufacturing variability.

Suspension systems in accordance with aspects of the present disclosure may have features that are movable or otherwise adjustable (e.g., pivotable, rotatable, telescoping, etc.) such that the suspension system may be suitably installed in a helmet having a stabilizing member attachment site location that falls within a range of locations. For example, one or more stabilizing members of a suspension system may be pivoted or otherwise suitably adjusted to align an attachment portion of the stabilizing member with a stabilizing member attachment site location (e.g., an attachment hole in a helmet). Such adjustment may be beneficial to accommodate variations in the location of the attachment sites on different helmets.

In some embodiments, a suspension system may include an upward stabilizing member that extends from a support portion of the suspension system. The suspension system also may include a downward stabilizing member that is movably attached (e.g., pivotally attached) to the upward stabilizing member. The downward stabilizing member may be configured to be attached to an interior surface of a helmet. For example, the downward stabilizing member may have an attachment end, located opposite a pivot end, that is attachable via a fastener, adhesive, or other suitable manner, at one or more suitable locations to the interior surface of a helmet (e.g., the interior surface of a protective shell).

The upward and downward stabilizing members may be longitudinal members made of a thin, planar, rigid material which resists tension and compressive forces, but permits bending in a direction normal to its plane. In this manner, the stabilizing members allow the adjustable band or fit-adjustment support band to move radially inward when the adjustable band is tightened.

A fit-adjustment support portion is a portion of the suspension assembly which both supports the helmet on the wearer's head and also provides the ability to adjust the fit of the suspension system. For example, a fit-adjustment support portion may form a part of a fit band, and also include a twistable dial which tightens and/or loosens an adjustable fit band which extends around a circumference of the wearer's head. In some embodiments, a fit-adjustment support portion of the suspension system may have a first side and a second side. A pair of upward stabilizing members may extend from each of the two sides of the fit-adjustment support portion.

In some cases, the incorporation of more than one stabilizing member (e.g., extending upward from the fit-adjustment support portion) may further serve to enhance stability of the helmet assembly during use. In addition, more than one stabilizing member assembly which includes both and upward and a downward stabilizing member also may be attached to an interior surface of a helmet.

FIG. 1 depicts an illustrative embodiment of a helmet assembly 10 which includes a protective shell 20 and a retention system 30. The protective shell 20 provides the main obstruction that shields the head of the wearer from external impact force(s). The protective shell includes attachment sites 26 (e.g., screw holes) through which corresponding fastening devices 24 (e.g., threaded screws) may be inserted for attaching the shell to interior components.

The retention system 30 includes a strap 32 and a number of adjustment devices 34 (e.g., lock/release components, adjustment clips) for tightening, loosening and locking portions of the strap with respect to the head of the wearer. The retention system 30 may include a lower strap region for wrapping around the mandible of the wearer. Once this lower strap region is suitably placed around the mandible, the retention system may be tightened, loosened, and/or locked accordingly.

As shown in FIGS. 2-5, the helmet assembly further includes a suspension system 100 having a lining 110 (e.g., a fabric mesh lining), an adjustable band 120 (e.g., a plastic fit-band), and attachment members 130 (e.g., fabric/plastic hooks, clips). The attachment members 130 attach the lining 110 to the adjustable band 120.

Figure 3:
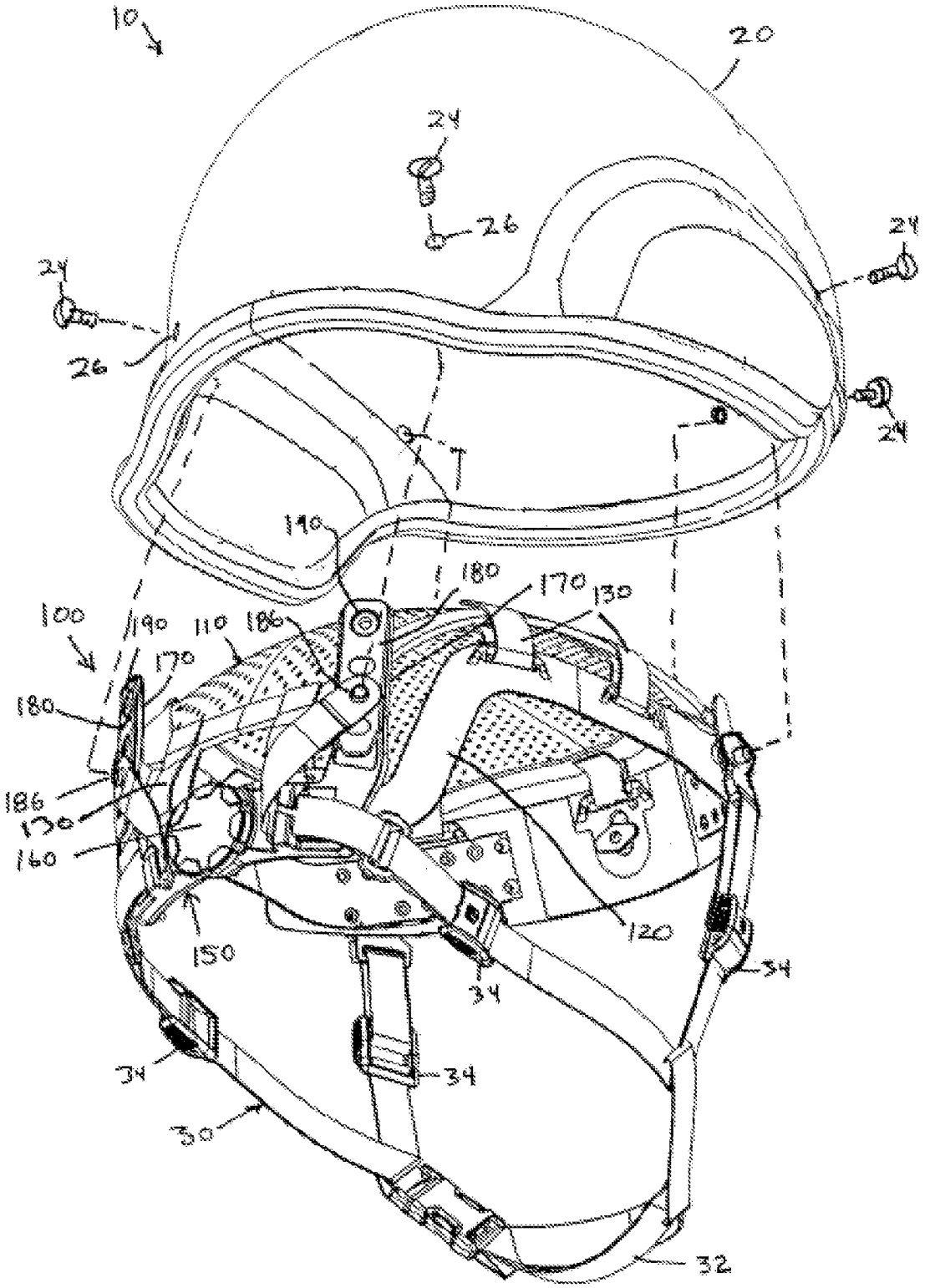
FIG. 3 shows an exploded perspective view of a helmet assembly in accordance with one embodiment.
Figure 4:
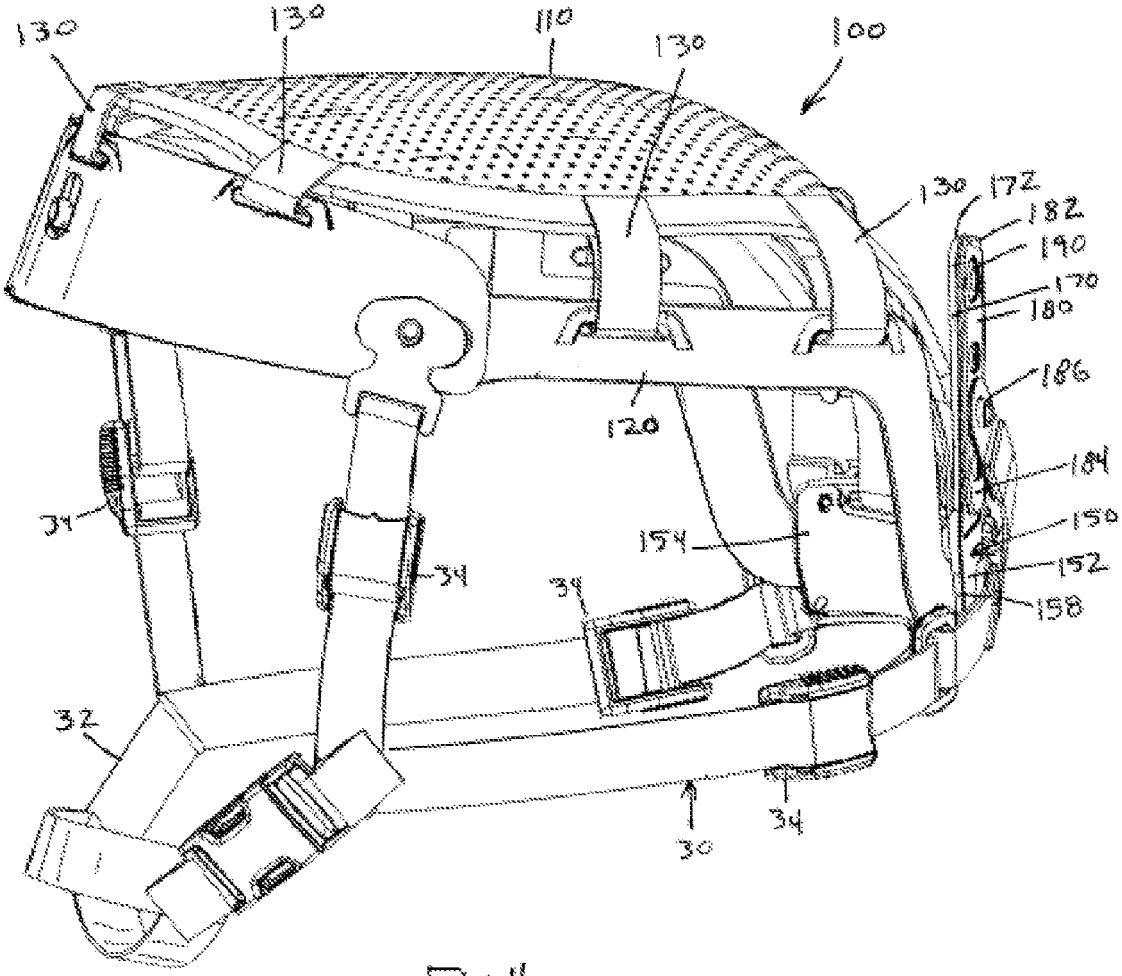
FIG. 4 depicts a perspective side view of a suspension system in accordance with one embodiment.
Figure 5:
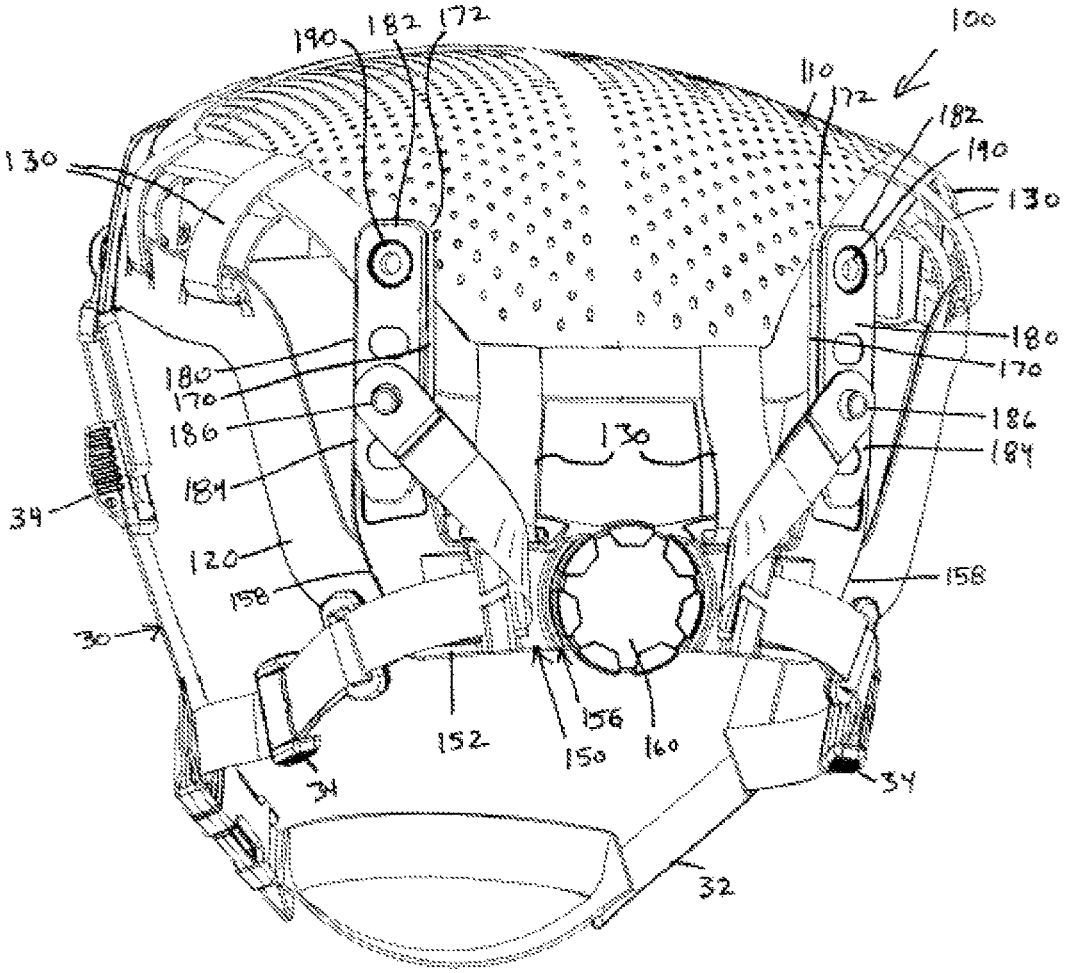
FIG. 5 illustrates a perspective rear view of a suspension system in accordance with one embodiment.

The suspension system 100 further includes a fit-adjustment support portion 150 that provides a support structure as well as a housing for a mechanism that is configured to control tightening and loosening the adjustable band 120. While the fit-adjustment support portion 150 is shown at the rear of the suspension system in FIG. 2, it should be appreciated that the fit-adjustment support portion may be located at any suitable position. As discussed in further detail below, upward stabilizing members 170 extend from ends 158*a*, 158*b* of the fit-adjustment support portion 150; and downward stabilizing members 180 are pivotally attached to the upward stabilizing members. Downward stabilizing members 180 may be attached to the helmet, for example, at an attachment site 26 of the helmet, as shown in FIG. 3.

In some embodiments, the fit-adjustment support portion 150 is stiffer than other components of the suspension system, such as the mesh lining 110, adjustable band 120 and/or attachment members 130. The mesh lining and/or the adjustable band are arranged to contribute to a suitable fit to the head of a wearer. Thus, the mesh lining 110 and/or adjustable band 120 may be substantially more prone to deformation than the fit-adjustment support portion 150 whose function is more suitable for housing the adjuster to the adjustable band. Accordingly, attaching the stabilizing members disclosed herein to the fit-adjustment support portion 150 can provide more stability to the helmet than attaching the same members to other portions of the suspension system in some embodiments.

In some embodiments, the adjustable band 120 comprises a material that is resistant to both tensile and compressive forces, such as a plastic, metal, or other material that holds its shape. Though, in some embodiments, the mesh lining 110 includes a material that is generally unable to resist compression (e.g., fabric).

As described further below, the fit-adjustment support portion 150 may provide a housing for a suitable anchoring mechanism to which the stabilizing members are attached in a manner that enhances stability of the suspension system and the helmet assembly.

Figure 6:
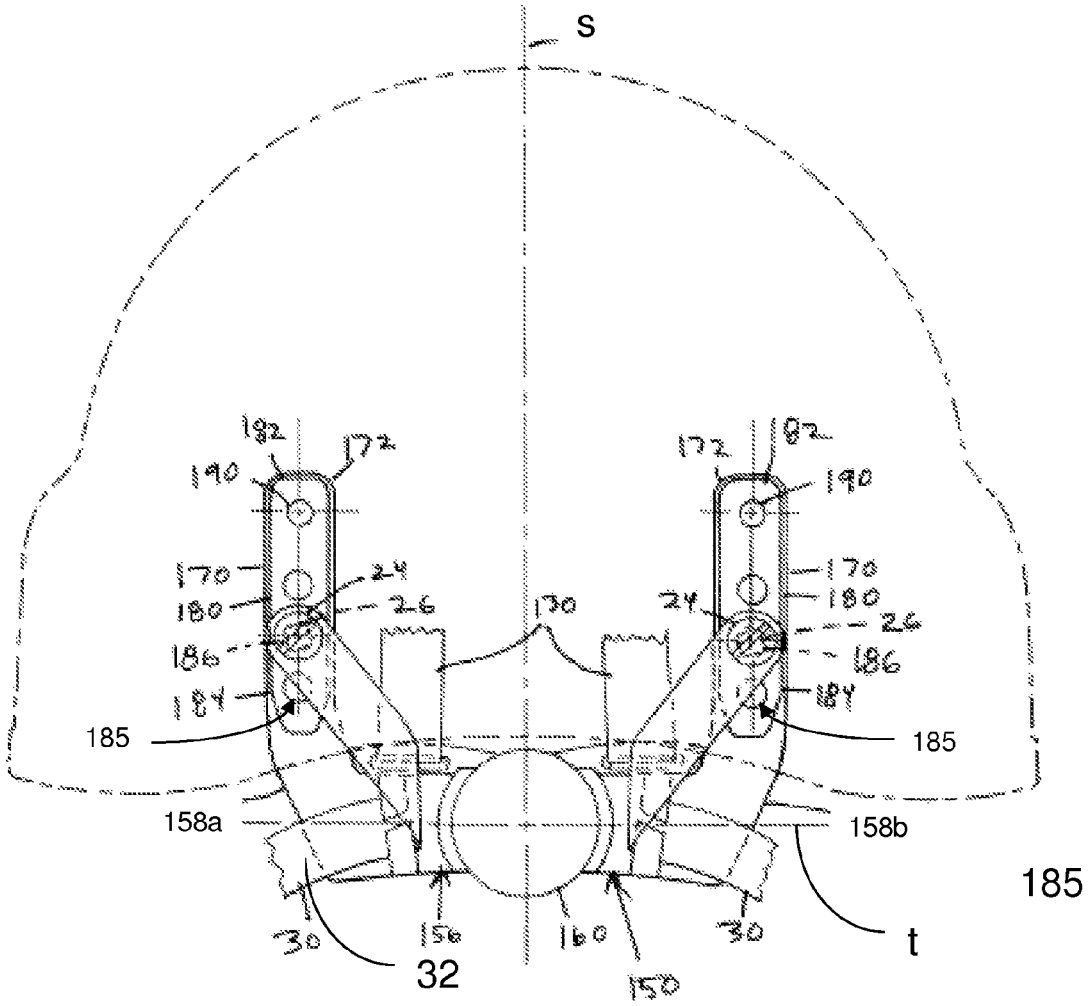
FIG. 6 is a schematic rear view of a portion of a suspension system in accordance with one embodiment.

Referencing FIGS. 6-10, the fit-adjustment support portion 150 has first and second ends 158*a*, 158*b* located opposite one another along a transverse plane t of the fit-adjustment support portion. FIG. 6 shows a rear view of an illustrative embodiment of the suspension system for a helmet assembly. Here, the suspension system has been tightened to fit the head of a wearer.

In some embodiments, each of the upward stabilizing members 170 are integrally attached at respective ends 158*a*, 158*b* of the fit-adjustment support portion 150 and extend therefrom. That is, in some embodiments, as illustratively shown further below in FIG. 12, the upward stabilizing member 170 and a first housing portion 152 of the fit-adjustment support portion may comprise a single monolithic material.

While upward stabilizing member 170 may be integrally attached to the fit-adjustment support portion 150, it should be appreciated that other arrangements are possible. For example, an upward stabilizing member 170 may be a separate component from the fit-adjustment support portion 150 and may be attached to the fit-adjustment support portion 150 by a fastener, or may be attached indirectly through another component, or may be attached by any other suitable technique. The upward stabilizing member 170 may be removably attached to the fit-adjustment support portion 150. In some embodiments, either of the first or second housing portions 152, 154, or both, may include one or both of the upward stabilizing members. In some embodiments, the second housing portion 154 may include at least one or both of the upward stabilizing members extending therefrom.

The fit-adjustment support portion 150 may provide for increased stiffness and support for components of the suspension system so as to resist undesirable movement of the helmet assembly during use (e.g., bounce, rotation, pitch, yaw). That is, the fit-adjustment support portion 150 may serve as a stabilizing anchor for the helmet, and be connected to the helmet via the upward and downward stabilizing members.

The fit-adjustment support portion 150 and the adjustable band 120 may provide some or all of the support for the weight of the helmet itself. It should be appreciated, however, that the fit-adjustment support portion and/or other support portions of the suspension assembly may not directly support the weight of the helmet in some embodiments. For example, the mesh lining may carry the most or all of the weight of the helmet in some embodiments while the adjustable band and/or fit-adjustment support portion only provide support in resisting movements of the helmet relative to the wearer's head.

Upward stabilizing members 170 may have a pivot end 172 (e.g., upper end) and downward stabilizing members 180 may have a pivot end 182. Accordingly, each of the upward stabilizing members 170 that extends from the fit-adjustment support portion 150 may form a pivotal attachment 190 to a downward stabilizing member 180 at their respective pivot ends. In some embodiments, the pivot 190 between the upward and downward stabilizing members is, itself, attached to the helmet. Though, in other embodiments, the pivot 190 between the upward and downward stabilizing members remains unattached to the helmet.

The downward stabilizing member 180 is further configured to be attached to an interior surface of a helmet at an attachment end of the stabilizing member. In some embodiments, the interior surface of the helmet to which the downward stabilizing member is attached is the interior surface of the protective shell, resulting in a secure attachment.

Thus, in some embodiments, the upward stabilizing member 170 is attached to and extends from a relatively stiff fit-adjustment support portion 150; and the downward stabilizing member 180 is attached directly to an interior surface of the helmet. Alternatively, in some embodiments, rather than a downward stabilizing member 180 being attached directly to the helmet, an upper end of an upward stabilizing member 170 may be attached directly to the helmet. For example, a pair (or more) of upward stabilizing members 170 may extend from opposite sides 158*a*, 158*b* of the fit-adjustment support portion 150 and upper ends of the upward stabilizing members may be attached to the interior surface of the helmet. The resistance of the stabilizing members to longitudinal tension, longitudinal compression, and twisting stabilizes the helmet relative to the suspension system.

In some embodiments, downward stabilizing members movably attached to upward stabilizing members may be attached to a helmet at a lower position as compared to where a single upward stabilizing member might be attached (i.e., a stabilizing assembly that does not include a downward stabilizing member). For example, a single upward stabilizing member attached to the helmet by itself may extend a sufficient length upwardly along the interior surface of the helmet to have a bending flexibility that permits radial adjustment of the adjustable band. In such a case, the upward stabilizing member would generally have to extend further up along the interior surface of the helmet to its helmet attachment as compared to a double stabilizing member arrangement. As described herein, the attachment site of the downward stabilizing member may be closer to the rim 22 of the helmet while providing a length that allows bending flexibility to accommodate radial movement of the adjustable band.

Figure 7:
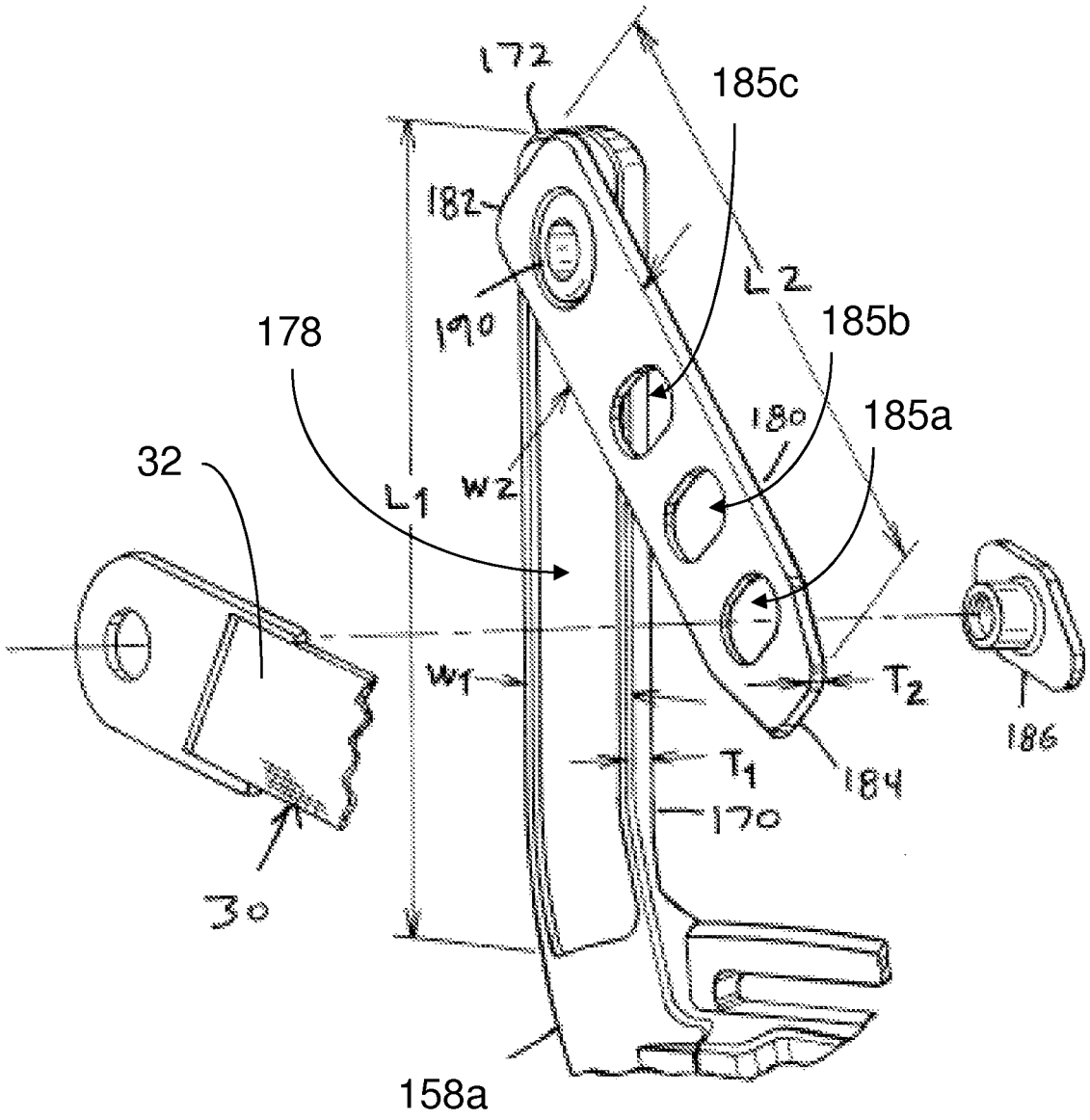
FIG. 7 shows an exploded rear view of a portion of a suspension system in accordance with one embodiment.

FIG. 7 illustrates a closer view of the upward and downward stabilizing members 170, 180. As shown, the attachment end 184 of the downward stabilizing member 180 has a number of holes 185*a*, 185*b*, 185*c* through which the fastener 186 may be inserted. In addition, the upward stabilizing member 170 includes a recess 178 to accommodate the head of the fastener 186 upon attachment of the downward stabilizing member 180 to a helmet.

Upward and downward stabilizing members described herein may have any suitable dimensions. For example, upward stabilizing member 170 may have any suitable width $W_1$, thickness $T_1$, length $L_1$, and corresponding aspect ratios, such as the width to thickness ratio, the length to thickness ratio, and the length to width ratio. As shown in FIG. 7, the length $L_1$ of the upward stabilizing member 170 is measured from the far edge at the pivot end 172 (i.e., at the upper end of the upward stabilizing member) to a region where the upward stabilizing member begins to extend from the side 158*a* of the fit-adjustment support portion 150. Downward stabilizing member 180 may have any suitable width $W_2$, thickness $T_2$, length $L_2$, and corresponding aspect ratios, for example, the width to thickness ratio, the length to thickness ratio, and the length to width ratio.

FIG. 7 illustrates an upward stabilizing member 170 and a downward stabilizing member 180 with reference to their respective widths, thicknesses, and lengths. The upward and downward stabilizing members may have respective dimensions (e.g., width, thickness, and/or length) that are similar in magnitude. Or, the upward and downward stabilizing members may have respective dimensions that are different. Such dimensions may be beneficial to reduce or eliminate pitch, yaw or roll rotations of the helmet in response to forces on the helmet, whether the forces come from external objects or movements of the wearer's head. The upward and downward stabilizing members may have any suitable dimensions and aspect ratios of those dimensions. Each of the upward stabilizing member and the downward stabilizing member may have the same or different dimensions and aspect ratios.

In some embodiments, upward and/or downward stabilizing members may have a width $W_1$, $W_2$ of between about 0.1 cm and about 5 cm, between about 0.5 cm and about 4 cm, or between about 1 cm and about 3 cm. For example, the width $W_1$, $W_2$ of an upward and/or downward stabilizing member may be approximately 1.5 cm, 2.0 cm, or any other suitable width.

In some embodiments, upward and/or downward stabilizing members may have a thickness $T_1$, $T_2$ of between about 0.1 mm and about 10 mm, between about 0.5 mm and about 5 mm, or between about 1 mm and about 3 mm. For example, the thickness $T_1$, $T_2$ of an upward and/or downward stabilizing member may be approximately 2 mm, 3 mm, or any other suitable thickness.

In some embodiments, upward and/or downward stabilizing members may have a length $L_1$, $L_2$ of between about 1 cm and about 10 cm, between about 2 cm and about 7 cm, or between about 3 cm and about 5 cm. For example, the length $L_1$, $L_2$ of an upward and/or downward stabilizing member may be approximately 4 cm, 4.5 cm, or any other suitable length.

In some embodiments, upward and/or downward stabilizing members may have a length to width aspect ratio of between about 1:1 and about 10:1, between about 2:1 and about 7:1, or between about 3:1 and about 5:1. For example, the length to width aspect ratio of an upward and/or downward stabilizing member may be approximately 3:1, 4:1, or 10:1, or any other suitable aspect ratio.

In some embodiments, upward and/or downward stabilizing members may have a length to thickness aspect ratio of between about 10:1 and about 200:1, between about 20:1 and about 100:1, or between about 30:1 and about 60:1. For example, the length to thickness aspect ratio of an upward and/or downward stabilizing member may be approximately 40:1, 50:1, or any other suitable aspect ratio.

In some embodiments, upward and/or downward stabilizing members may have a width to thickness aspect ratio of between about 5:1 and about 200:1, between about 10:1 and about 100:1, or between about 15:1 and about 50:1. For example, the width to thickness aspect ratio of an upward and/or downward stabilizing member may be approximately 20:1, 30:1, or any other suitable aspect ratio.

Figure 8:
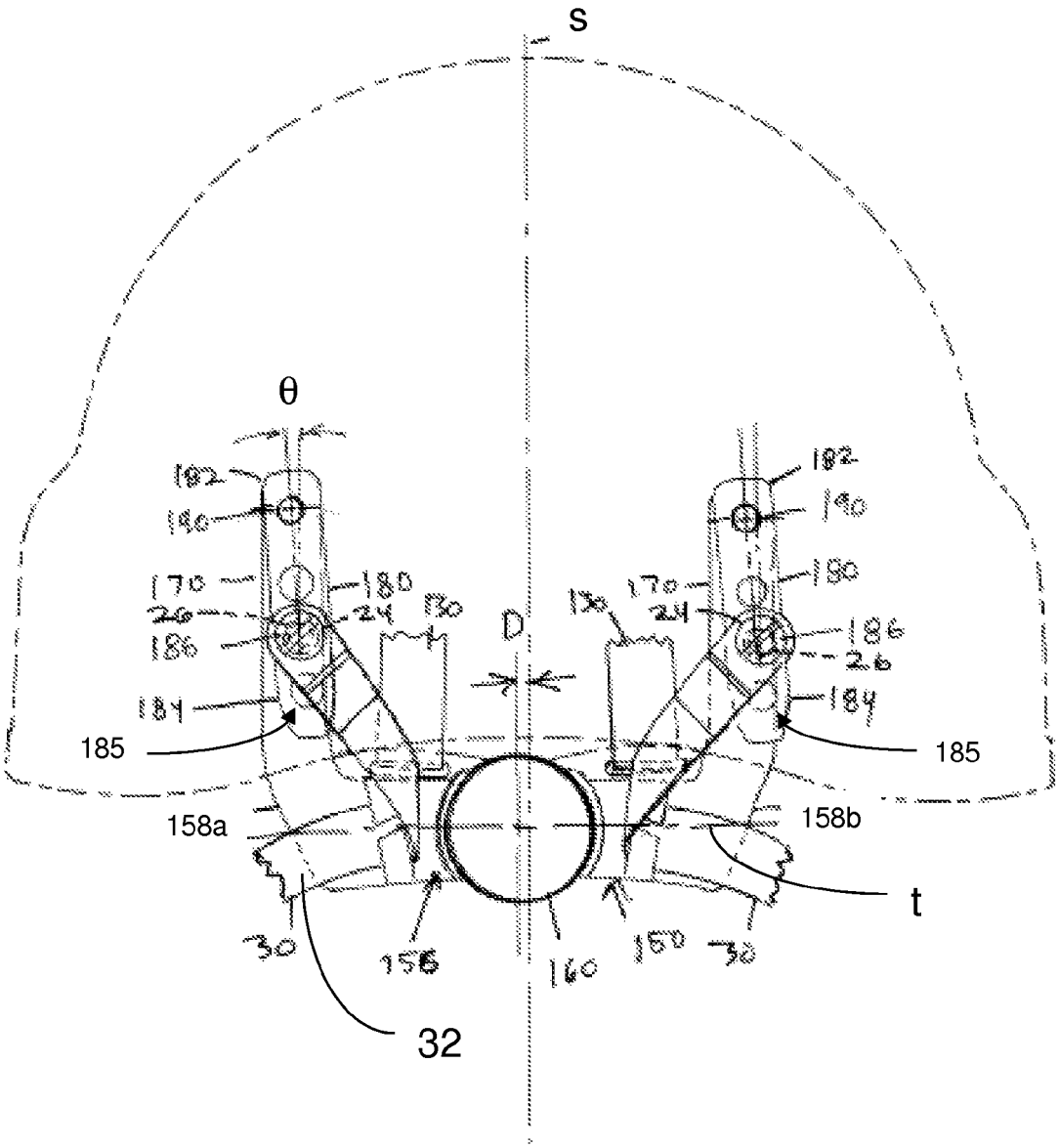
FIG. 8 is a schematic rear view of the suspension system of FIG. 6 subject to applied force(s)

FIG. 8 illustrates the mechanically resistive reaction of the suspension system to twisting force(s) that could otherwise cause substantial side-to-side movement, or yaw rotation of the helmet about a vertical axis. For example, in this embodiment, a substantial twisting force applied to the side of the helmet (e.g., by impact, change in momentum, etc.) may cause the upward and downward stabilizing members 170, 180 extending from each end 158*a*, 158*b* to form an angle θ (e.g., up to approximately 5-10 degrees) with respect to one another; and may further cause the central region 156 of the fit-adjustment support portion 150 to move a lateral distance D.

If the stabilizing members of the suspension system were not arranged in this manner, or in a similarly effective configuration, such a force may cause the helmet to shift substantially more; so much so that the wearer of the helmet may be more prone to discomfort, or motion sickness if using visual accessories attached to the helmet. Accordingly, the angle θ and the distance D would be greater for helmet assemblies not incorporating arrangements of stabilizing members described herein, yet subject to the same applied force during use.

While not expressly shown in the figures, the same or a similar configuration of components of the embodiment of FIG. 8 also may provide substantial resistance to force(s) that could otherwise give rise to a substantial degree of up-and-down movement, or pitch rotation of the helmet about a horizontal axis. Accordingly, arrangements of stabilizing members described herein may enhance the stability of a helmet assembly by suitably resisting undesirable, yet otherwise commonly occurring, movement during use.

Prior to attachment of the downward stabilizing member 180 to an interior surface of the helmet (e.g., to the interior surface of the protective shell, padding, etc.), the downward stabilizing member 180 may be free to rotate about the pivotal attachment 190 formed with the upward stabilizing member 170. As discussed further below, the ability to pivot freely allows the downward stabilizing member 180 to be suitably joined to a number of different types of helmets each having attachment sites located at different positions.

Any suitable arrangement may be used to form a pivotal attachment. For example, a mushroom-type head in post, eyelet construction, linked arrangement, or any other suitable construction may be used as known to those of ordinary skill in the art. As discussed, the pivot 190 between the upward and downward stabilizing members may or may not be attached to the helmet.

As shown, the downward stabilizing member 180 includes an attachment end 184 (e.g., lower end) located opposite the pivot end 182 (e.g., upper end), which may be attached, in any suitable manner, to an interior surface of a helmet (e.g., the protective shell, padding, etc.). The attachment end 184 has a number of attachment sites, such as those illustrated in the figures as a plurality of holes 185 through which a fastener 186 may be inserted for attachment of the downward stabilizing member 180 to an interior surface of the helmet.

In some embodiments, the site of attachment (i.e., hole through which a fastener is inserted/screwed) where the downward stabilizing member is attached to the helmet may be chosen to provide for appropriate height adjustment with respect to the head of the wearer. For example, if it is preferred for the helmet to sit higher on the head of the wearer, the downward stabilizing member 180 may be attached at the lowermost hole 185*a* of the attachment end 184 to the helmet. Conversely, if it is preferred for the helmet to sit lower on the head of the wearer, attachment of the downward stabilizing member 180 to the helmet may be set at the uppermost hole 185*c* of the attachment end. It can be appreciated that the attachment end 184 may have any suitable number of attachment sites (e.g., insert/screw holes) arranged in any suitable pattern.

As shown in FIGS. 6-10, the fastener 186 also joins the downward stabilizing member 180 to a portion of the strap 32 (e.g., flexible fabric) of the retention system 30. Such an attachment provides support for the strap as it wraps around the rear of the helmet assembly. Additionally, in the embodiment shown, the upward stabilizing member 170 includes a recess 178 (shown in FIG. 7) and the downward stabilizing member 180 also includes a recess 188 (shown in FIG. 12) that accommodate a portion of the fastener 186 (e.g., the head of the fastener) upon attachment of the downward stabilizing member 180 to the helmet and the fabric portion 32.

As discussed previously, suspension systems described herein may be installed in helmets that are subject to variability in manufacture. For instance, if an attachment site (e.g., insert/screw hole) for one protective shell varies from helmet to helmet by ⅛ of an inch, ¼ of an inch, ½ of an inch, an inch or even a greater distance laterally to either side, the pivotal arrangement discussed herein allows the position of the downward stabilizing member to be adjusted to accommodate such variability.

Figure 9:
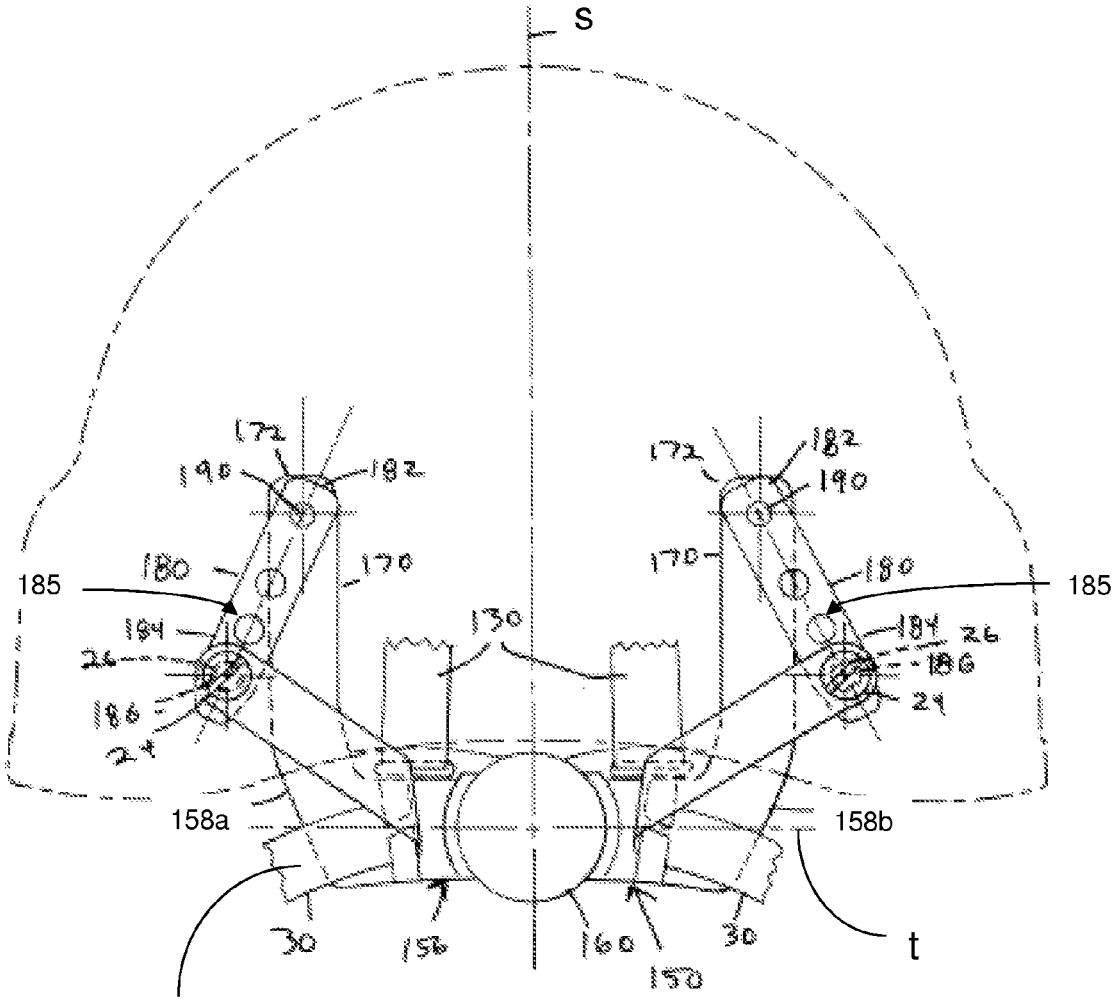
FIG. 9 shows a rear view of an alternative helmet assembly in accordance with one embodiment.

For example, a protective shell 20 for one helmet (e.g., shown in FIG. 6) may have attachment sites 26 that have different locations compared with attachment sites 26 for the protective shell 20 of a different helmet (e.g., shown in FIG. 9). However, certain suspension systems in accordance with the present disclosure may be adjustable so that the suspension systems may be installed in either helmet. It should be appreciated that any suitable adjustment mechanism other than a pivoting arrangement (e.g., telescoping members or otherwise movable components, etc.) may be used to provide adjustability in the placement of the downward stabilizing member.

In the example shown in FIG. 6, when the downward stabilizing member 180 is pivotally adjusted so that a hole of the attachment end 184 aligns with a corresponding attachment site 26 of the protective shell 20, upward and downward stabilizing members 170, 180 are also substantially aligned. However, in other embodiments, the upward and downward stabilizing members 170, 180 would not necessarily be substantially aligned.

The respective attachment sites 26 of other helmets may be at locations that differ from that of FIG. 6. Accordingly, to attach the same suspension system to a protective shell 20 having attachment sites 26 that differ in location than those of the helmet of FIG. 6, the downward stabilizing member 180 may be rotated about the pivot 190 such that a hole 185 of the attachment end 184 comes in line with the corresponding attachment hole 26 of the protective shell 20. FIG. 9 illustrates the downward stabilizing member 180 rotated outwardly from the sagittal plane s for attachment to the protective shell 20 at corresponding attachment sites 26. Accordingly, the pivotal arrangement between upward and downward stabilizing members allows for attachment of the suspension system across platforms and also to helmets subject to manufacturing variability.

Any appropriate method may be used to join the attachment end 184 of the downward stabilizing member, or other stabilizing member, to the interior of a helmet. In some embodiments, a fastener such as a bolt, nut, insert, rod, pin, screw or other threaded component, snap, latch, button, or any other fastening device that mechanically joins or affixes two or more objects together, may be used. Or, a stabilizing member may be joined to the interior of a helmet by another appropriate method, for example, crimping, welding, by use of an adhesive, cement, suction, friction/interference fit, solder, magnetic, etc. It should be appreciated that attachment of a stabilizing member to the interior of the helmet does not require a direct attachment. For example, a stabilizing member may be attached to the helmet through an intermediate leg positioned between the stabilizing member and the helmet, via a padding, in a linkage configuration, or other suitable arrangement.

Figure 10:
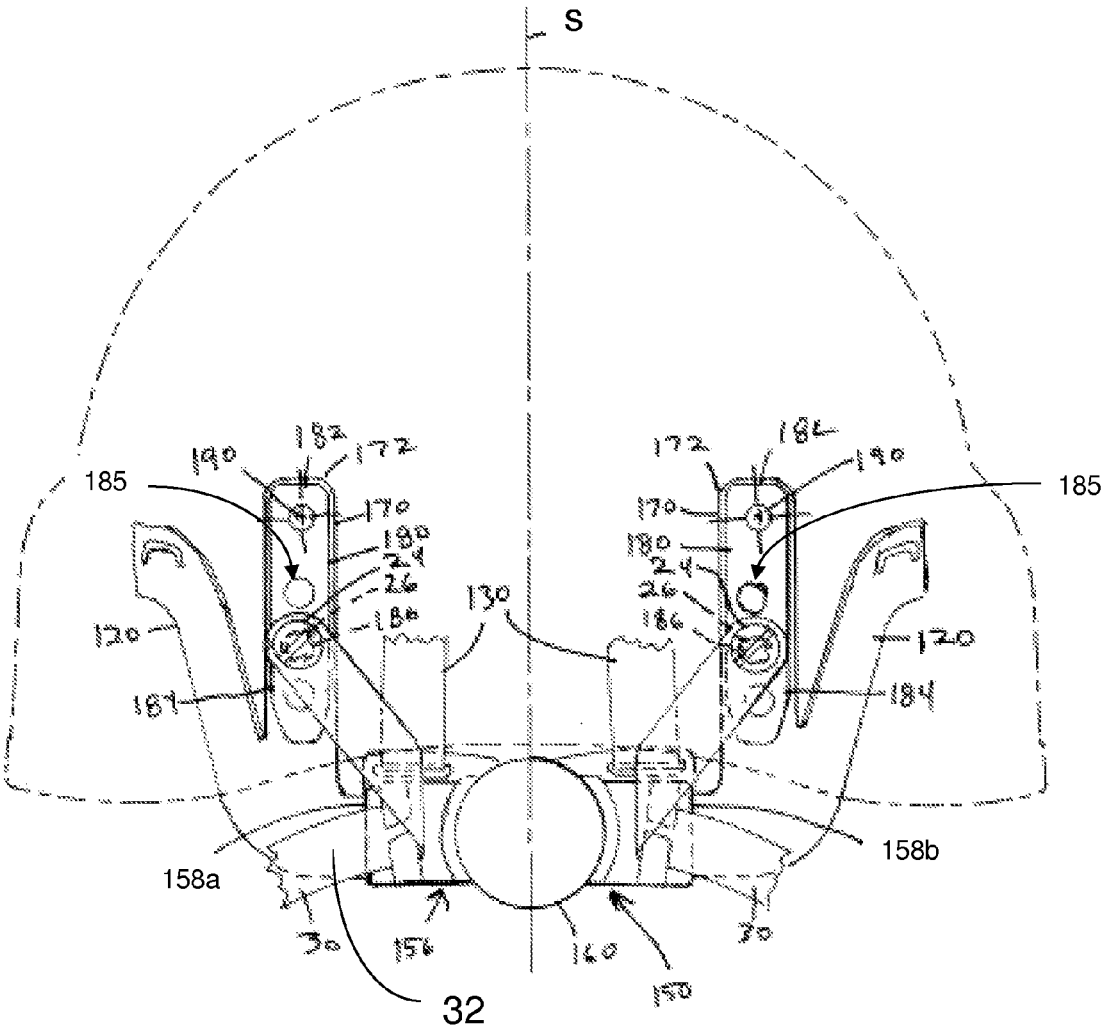
FIG. 10 is a schematic rear view of an alternative helmet assembly in accordance with one embodiment.

FIG. 10 illustrates an alternative embodiment of the suspension system 100. In this embodiment, the upward stabilizing members 170 are attached directly to, and extend from, the adjustable band 120. In some embodiments, the upward stabilizing members 170 also extend from respective ends 158*a*, 158*b* of the adjustment support member 150. In various embodiments, the upward stabilizing member 170 is a separate component from the adjustable band and attached thereto; or the upward stabilizing member 170 is integrally attached to the adjustable band.

Accordingly, in the embodiment of FIG. 10, upon actuation of the adjustment device 160, a portion of the upward stabilizing member 170 moves with the adjustable band 120 as the band is tightened or loosened. For example, if the adjustable band 120 is tightened such that portions of the adjustable band move toward each other, a portion of the upward stabilizing member 170 (e.g., a lowermost region of the upward stabilizing member at the site of attachment to the adjustable band) moves together with the band toward the fit-adjustment support portion 150. Conversely, if the adjustable band 120 is loosened, that portion of the upward stabilizing member 170 may move together with the band away from the fit-adjustment support portion 150.

In contrast, in the embodiment illustrated in FIGS. 6-9, when the adjustable band 120 is tightened or loosened, the upward stabilizing member 170 remains stationary relative to the fit-adjustment support portion 150 because the upward stabilizing member 170 is attached to the fit-adjustment support portion 150.

However, in both of the above embodiments (FIGS. 6 and 10), when the adjustment device 160 is actuated to tighten or loosen the adjustable band 120, as portions of the adjustable band move through the fit-adjustment support portion 150, the fit-adjustment support portion might not move with the adjustable band 120 in a circumferential direction with respect to the overall helmet assembly. However, the fit-adjustment support portion 150 itself may move in a direction radially inward or outward with respect to the helmet assembly. For instance, when a circumference of the suspension system constricts to fit the head of a wearer, the position of the fit-adjustment support portion 150 may shift appropriately inward in cooperation with overall constriction of the suspension system.

Each of the upward and downward stabilizing members 170, 180 and the fit-adjustment support portion 150 from which the upward stabilizing member extends may comprise any suitable material. In some embodiments, a molded polymer may be used. For example, the material making up any of the upward stabilizing member, the downward stabilizing member, or the fit-adjustment support portion may include a plastic, such as polyethylene (e.g., high-density, low-density), nylon, polyamide, polyimide, polyester, polyethylene terephthalate, polyvinyl chloride, polypropylene, polystyrene, acrylonitrile butadiene styrene, polycarbonate, polyurethane, para-aramid synthetic fiber (e.g., KEVLAR®), or any other suitable polymeric material. In other embodiments, at least one of the upward stabilizing member, the downward stabilizing member, and the fit-adjustment support portion may comprise a material other than plastic or polymer, such as metal (e.g., aluminum, tin, titanium, etc.), carbon (e.g., graphite), glass, fiberglass, fibrous material, etc. It should be appreciated that each of the upward and downward stabilizing members, and the fit-adjustment support portion may comprise the same or different material.

Each of the upward and downward stabilizing members and the fit-adjustment support portion may exhibit any suitable stiffness characteristics. For example, in some cases, each of the upward and downward stabilizing members and the fit-adjustment support portion may be more stiff than the adjustment band. However, in some cases, the stiffness of the adjustment band may be comparable to the stiffness of any one of the upward stabilizing member, the downward stabilizing members, or the fit-adjustment support portion from which the upward stabilizing member extends. It should be appreciated that each of the upward and downward stabilizing members, and the fit-adjustment support portion may exhibit the same or different stiffness characteristics.

Figure 11:
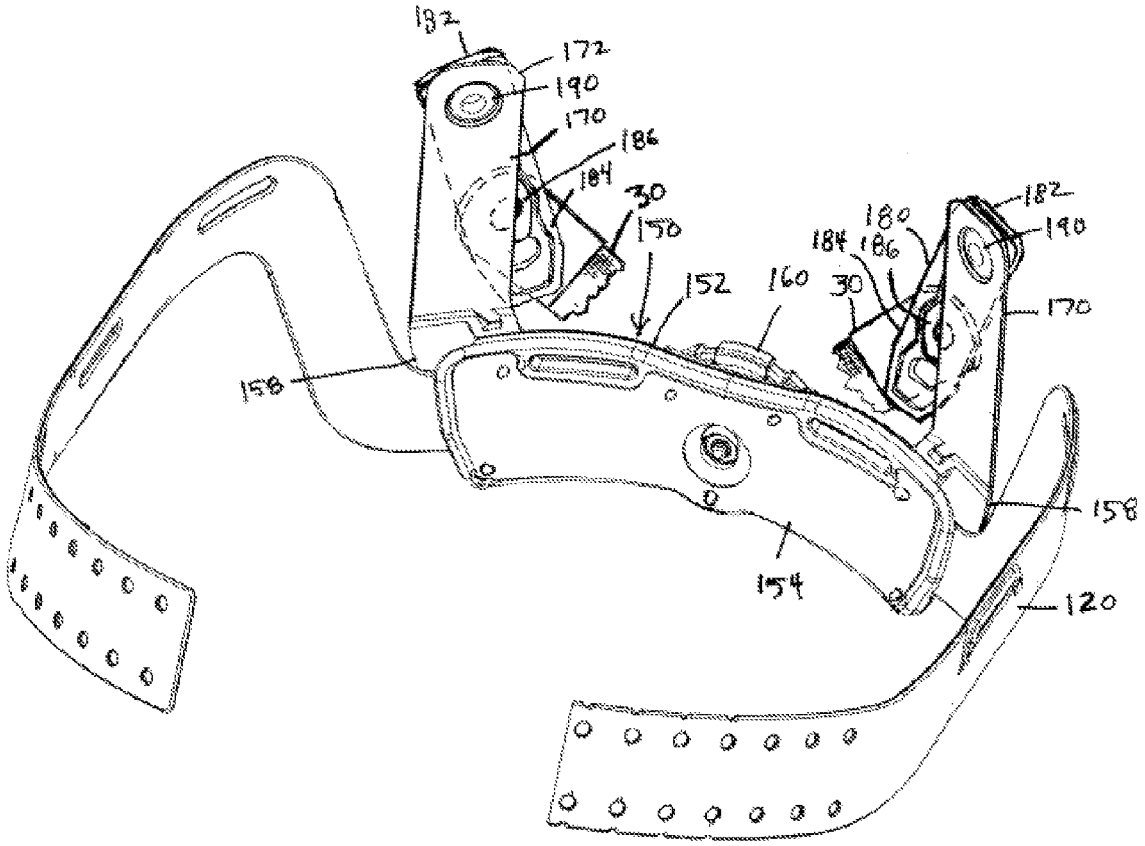
FIG. 11 shows a perspective view of portions of a suspension system in accordance with one embodiment.
Figure 12:
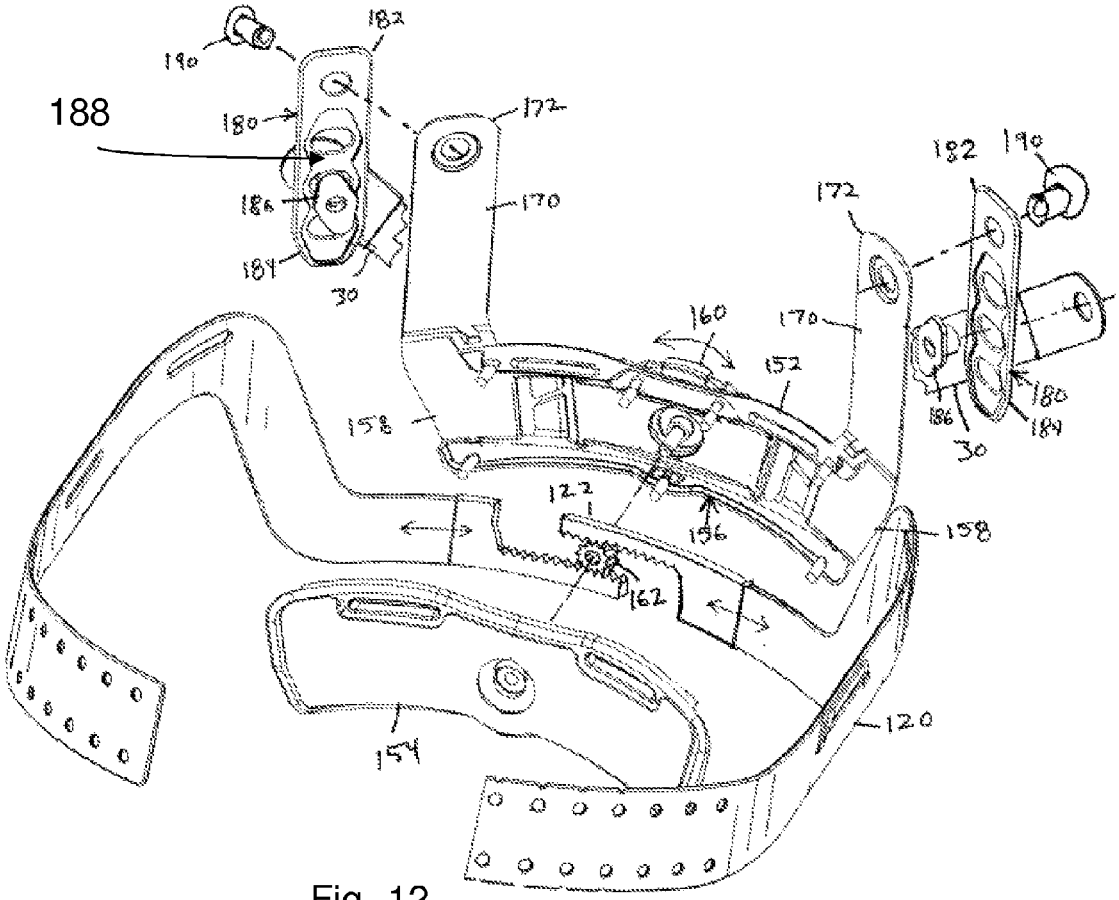
FIG. 12 depicts an exploded perspective view of the portions of the suspension system of FIG. 6.

The fit-adjustment support portion 150 of the suspension system may include any suitable arrangement of parts and is not limited to the embodiments disclosed herein. In the embodiment shown in FIGS. 11-12, the fit-adjustment support portion 150 includes a first housing portion 152 having an outer surface facing toward the rear of the helmet and a second housing portion 154 having an outer surface that faces toward the front of the helmet. As shown in FIG. 12, first and second housing portions 152, 154 are arranged as two halves in a configuration where the housing portions may be suitably fastened together. In other embodiments, the fit-adjustment support portion 150 may include first and second housing portions arranged in a clam-shell type configuration, a snap fit configuration, or another suitable arrangement.

The upward stabilizing members 170 are integrally attached to the first housing portion 152 of the fit-adjustment support portion 150. However, as discussed above, other arrangements of the upward stabilizing members 170 with respect to the first housing portion 152 of the fit-adjustment support portion 150 are possible.

The first housing portion 152 and the second housing portion 154 may provide a support housing for an adjustment device 160 optionally located at a central region 156 of the fit-adjustment support portion 150. The adjustment device 160 may be appropriately coupled with the adjustable band 120 so as to provide for tightening and loosening control of the band. As shown in the figures, the adjustable band 120 may be coupled to the adjustment device 160 while also being sandwiched between the first and second housings 152, 154. Such adjustment control may provide for suitable fitting of the suspension system around the circumference of the head of the wearer.

As shown in the figures, the adjustment device 160 may optionally comprise a dial where rotation of the dial in one direction (e.g., clockwise) serves to tighten the adjustable band 120 and rotation of the dial in the opposite direction (e.g., counter-clockwise) serves to loosen the adjustable band 120. The exploded view of FIG. 12 depicts how rotation of the adjustment device 160 in either direction (shown by the double sided reference arrows) causes a pinion 162 to rotate. The pinion 162 has teeth that fit in a complementary manner with corresponding teeth of a rack at respective end portions 122 of the adjustable band 120.

As the dial is turned, the pinion is rotated causing the adjustable band 120 to move in between respective housing portions 152, 154 of the fit-adjustment support portion 150, as shown by the corresponding double sided reference arrows. Thus, when the dial is turned so that the end portions 122 move toward one another, the adjustable band 120 is tightened; conversely, when the dial is turned in a manner such that the end portions 122 move away from one another, the adjustable band 120 is loosened. In addition, when the helmet assembly is worn, the adjustment device 160 extends below the rim 22 of the protective shell 20 so that adjustments in tension to the adjustable band 120 are conveniently made. It can be appreciated that any other suitable adjustment device may be used to control tensioning of the adjustable band 120 as the embodiment shown is for illustrative purposes only.

In some embodiments, the support portion that encircles a wearer's head may not be adjustable, and the suspension system may not include an adjustment device. Stabilizing assemblies described herein may be used with such a suspension system.

Having thus described several aspects of at least one embodiment of this invention, it is to be appreciated various alterations, modifications, and improvements will readily occur to those skilled in the art. Such alterations, modification, and improvements are intended to be part of this disclosure, and are intended to be within the spirit and scope of the invention. Accordingly, the foregoing description and drawings are by way of example only.

What is claimed is:

1. A suspension system for a helmet assembly, the suspension system comprising:

a support portion adapted to engage a wearer's head to help support the helmet assembly in an upright position on the wearer's head when worn;

an upward stabilizing member extending upwardly from the support portion; and a downward stabilizing member directly and pivotally attached to the upward stabilizing member and extending downwardly from its pivotal attachment with the upward stabilizing member when the upward stabilizing member is extending upwardly from the support portion when the helmet assembly is in the upright position when worn.

2. The suspension system of claim 1, wherein the upward stabilizing member is removably attached to the support portion.

3. The suspension system of claim 1, wherein the upward stabilizing member is integrally attached to the support portion.

4. The suspension system of claim 1, wherein the support portion is located at a rear of the suspension system.

5. The suspension system of claim 1, wherein the downward stabilizing member comprises an attachment end having a plurality of holes arranged for attachment of the attachment end to an interior surface of the helmet assembly.

6. The suspension system of claim 1, wherein at least one of the upward and downward stabilizing members has a length of between 1 cm and 10 cm.

7. The suspension system of claim 1, wherein the upward stabilizing member has a length and a width, and a length to width aspect ratio of the upward stabilizing member is between 1:1 and 10:1.

8. The suspension system of claim 1, further comprising an adjustable band that is adjustable and adapted to fit a circumference of a head of a wearer.

9. The suspension system of claim 8, wherein the upward stabilizing member is attached to the adjustable band.

10. The suspension system of claim 8, further comprising a fit-adjustment device adapted to tighten or loosen the adjustable band.

11. The suspension system of claim 8, wherein the adjustable band is more flexible than the support portion.

12. The suspension system of claim 8, wherein the adjustable band is radially adjustable and adapted to fit the suspension system to a circumference of a head of a wearer.

13. The suspension system of claim 1, wherein the upward stabilizing member extends from a first side of the support portion.

14. The suspension system of claim 13, further comprising a second upward stabilizing member extending from a second side of the support portion.

15. The suspension system of claim 1, wherein the helmet assembly comprises a protective shell and the suspension system is attached to an interior surface of the protective shell.

16. The suspension system of claim 1, wherein the downward stabilizing member has a length and a width, and a length to width aspect ratio of the downward stabilizing member is between 1:1 and 10:1.

* * * * *